US005102264A

United States Patent [19]

Thomas et al.

[11] Patent Number: 5,102,264

[45] Date of Patent: Apr. 7, 1992

[54] DEVICE FOR THE INTEGRATED SUSPENSION AND MANIPULATION OF THE LEGS OF A JACK-UP PLATFORM

[75] Inventors: Pierre-Armand Thomas, Puteaux; Lucien Raffoux, Sartrouville; Guy Delamare, Le Pecq, all of France

[73] Assignee: Technip Geoproduction, Paris La Defense, France

[21] Appl. No.: 601,858

[22] Filed: Oct. 24, 1990

[30] Foreign Application Priority Data

Oct. 24, 1989 [FR] France ..... 89 13934

[51] Int. Cl.[5] ..... E02B 17/08

[52] U.S. Cl. ..... 405/198; 405/196; 405/203; 114/265

[58] Field of Search ..... 114/265; 267/141, 153, 267/154, 279; 405/195, 196, 198, 199, 203, 224

[56] References Cited

U.S. PATENT DOCUMENTS

| | | | |
|---|---|---|---|
| 3,245,658 | 4/1966 | Sutton | 405/198 X |
| 3,323,763 | 6/1967 | Butts | 267/153 X |
| 4,171,027 | 10/1979 | Seit et al. | 267/153 X |
| 4,195,950 | 4/1980 | Goldman | 405/195 |
| 4,688,662 | 8/1987 | Correll | 188/268 |
| 4,813,814 | 3/1989 | Shibuta et al. | 405/198 |

FOREIGN PATENT DOCUMENTS

| | | | |
|---|---|---|---|
| 5655 | 7/1982 | European Pat. Off. | 405/196 |
| 271377 | 6/1988 | European Pat. Off. . | |
| 2492029 | 4/1982 | France . | |

*Primary Examiner*—Randolph A. Reese
*Assistant Examiner*—John A. Ricci
*Attorney, Agent, or Firm*—Wenderoth, Lind & Ponack

[57] ABSTRACT

A device for the integrated suspension and manipulation of legs supporting a jack-up oil platform having a hull mounted displaceably on the legs by drive mechanisms having at least two opposite units each formed by a motor associated with at least one speed reducer driving an output gear co-operating with opposite racks mounted on at least part of the length of the legs. The opposite units of each drive mechanism are mounted in articulated fashion on a structure supporting them via at least one bearing allowing a determined angular deflection of the units and of each corresponding output gear. The motor and the speed reducer of each opposite unit are housed in a member for absorbing energy, used, in particular, at the moment of the placement of the legs on the sea bed and for limiting the stresses due to the flexure of the legs under the action of swells and the wind.

10 Claims, 8 Drawing Sheets

10
10
2
1
2a
2a
2a
2
4
3
4

DEVICE FOR THE INTEGRATED SUSPENSION AND MANIPULATION OF THE LEGS OF A JACK-UP PLATFORM

BACKGROUND OF THE INVENTION

The present invention relates to a device for integrated suspension and manipulation of the legs for supporting a platform for drilling or oil production at sea and relates more particularly to jack-up platforms.

Platforms of this type generally comprise legs which rest on the sea bed and a hull mounted so as to be displaceable and adjustable in height along the legs.

The whole platform is floated to the drilling or extraction site and the legs are lowered until they come into contact with the sea bed and then, resting on the legs, the hull is hoisted above the level of the sea to a height which puts it out of range of the highest waves.

The hull is thus displaceable along the legs of the platform by means of raising mechanisms integral with the hull and comprising output gears whose bearings are integral with the hull and co-operate with racks mounted on at least part of the length of the legs. These gears are motorized by a plurality of motors, for example electric motors, associated with speed reducers, the speed reducing ratio of which is very high.

At the moment of contact of a leg with the sea bed, at the end of the lowering operation, the impact can be very violent given the movements of the hull under the effect of a swell. These shocks reverberate in the raising mechanisms, severely stressing the multiple gearing of the speed reducers.

To obtain proper operation of the gearing of the speed reducers at the moment of contact of the legs with the sea bed, it is thus necessary to overdimension them significantly or to wait for favourable climatic conditions, thus increasing the costs of installation.

In order to remedy these disadvantages, a device for the suspension of the legs is known which consists of a turning balancing arm.

However, in this case the number of torsional turns of the balancing arm is limited, which reduces the damping travel, and the presence of this turning arm is dangerous for the personnel working on the platform.

FR-A-2 607 165 likewise discloses a device for the suspension of the legs of an oil platform which comprises at least one torsion bar, one of the ends of which is equipped with a gear meshing with a toothed sector mounted on the speed reducer and the other end of which is immobilized on the structure integral with the hull of the platform.

In this device, the torsion bar or bars are arranged parallel to the axis of rotation of the drive mechanism, increasing the size of the unit.

SUMMARY OF THE INVENTION

The invention thus aims to remedy the above-mentioned disadvantages by creating a device for the suspension of the legs of a jack-up oil platform which, while being of relatively simple construction, allows the size of the drive mechanism and the stresses due to the shocks in the structure and, above all, in the gear trains of the speed reducers to be reduced and the placement of the platform to be carried out in severe sea conditions, thus within wider meteorological windows, reducing the cost of installation.

The invention thus relates to a device for the integrated suspension and manipulation of the legs for supporting a jack-up oil platform comprising a hull mounted displaceably on the legs by means of drive mechanisms comprising at least two opposite units each formed by a motor associated with at least one speed reducer driving an output gear co-operating with opposite racks mounted on at least part of the length of the legs, the opposite units of each drive mechanism being mounted in articulated fashion on a structure supporting them via at least one bearing allowing a determined angular deflection of the units and of each corresponding output gear. The motor and the speed reducer, of which there is at least one, of each opposite unit are housed in a member for absorbing energy, used, in particular, at the moment of the placement of the legs on the sea bed and for limiting the stresses due to the flexure of the legs under the action of swells and the wind.

According to other characteristics of the invention:

the member for absorbing energy and limiting the stresses is formed by at least one twisting sleeve, one of the ends of which is driven in rotation by the corresponding geared motor unit and the other of the ends of which is integral with a crosspiece connecting each of two associated adjoining sleeves to the corresponding geared motor unit, each geared motor unit turning in the opposite direction to the other;

the sleeve of each geared motor unit is formed by at least two sections separated by an intermediate collar on which is fixed one of the ends of each section, the intermediate collars of the adjoining geared motor units are interconnected by at least one tie adjustable in length and immobilizing the intermediate collars mutually as regards rotation, the sleeve of each geared motor unit has each of its ends fixed on a collar, the sleeve of each geared motor unit is fixed on the collars by bonding, is the sleeve of each geared motor unit prestressed in compression, the means for prestressing in compression are formed by at least one tie parallel to the axis of the sleeve, one end of which is integral with the structure supporting the geared motor units and the other end of which is integral with the crosspiece connecting two adjoining sleeves.

BRIEF DESCRIPTION OF THE DRAWINGS

The invention will be better understood with the aid of the description which follows, given solely by way of example and with reference to the attached drawings, in which.

DETAILED DESCRIPTION OF THE INVENTION

Figure 1:
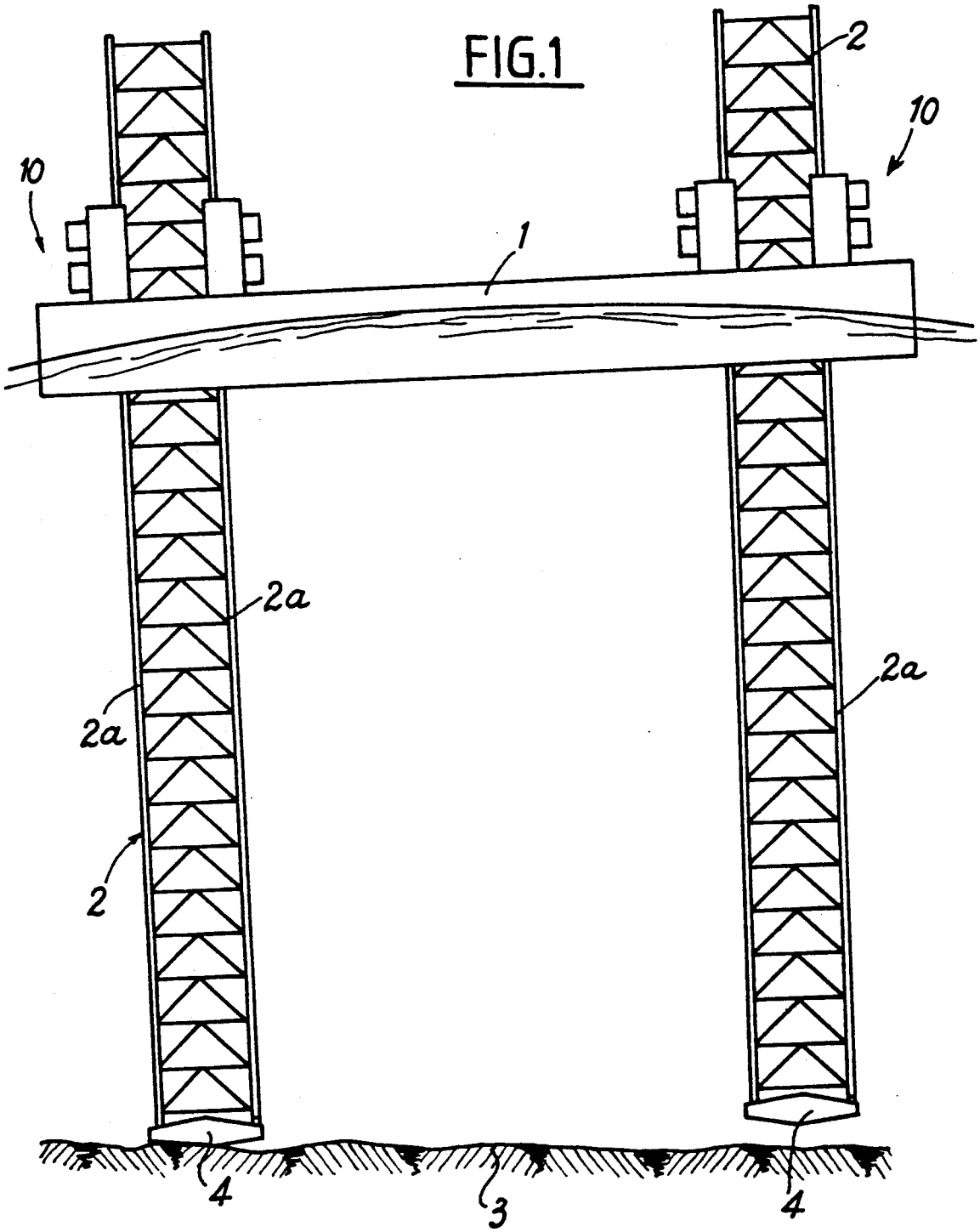
FIG. 1 is a schematic view in elevation of a jack-up oil platform shown in a leg-lowering configuration.

FIG. 1 represents schematically a jack-up oil platform comprising a hull 1 mounted displaceably on vertical legs 2 intended to rest on a sea bed 3 when the platform is in a drilling or extraction position.

In the present case, each of the vertical legs 2 has a triangular section and consists of three posts 2*a* linked together by a lattice of metal beams.

Such leg ends in its lower part 4, which, in the present example, is of hexagonal form.

At each leg 2, the platform is moreover equipped with a drive and suspension mechanism 10 for the hull in relation to the legs. This drive mechanism 10 allows the legs 2 to be lowered until they are in contact with the sea bed and then, resting on the legs, the hull 1 to be hoisted above the sea to a height which puts it out of range of the highest waves.

Figure 2:
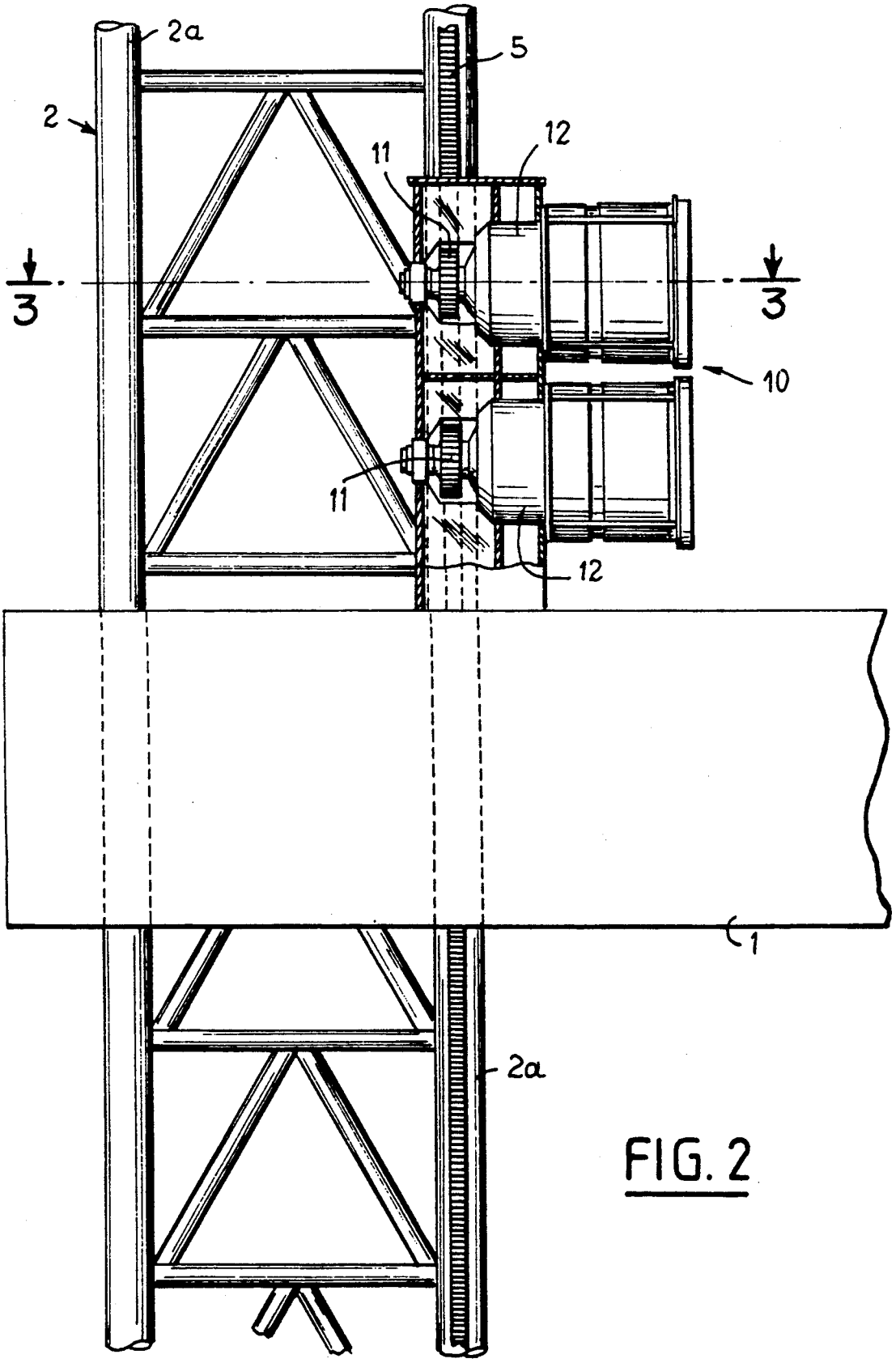
FIG. 2 is a schematic view on a larger scale of a section of one of the legs of the platform, showing a mechanism for driving the leg.
Figure 3:
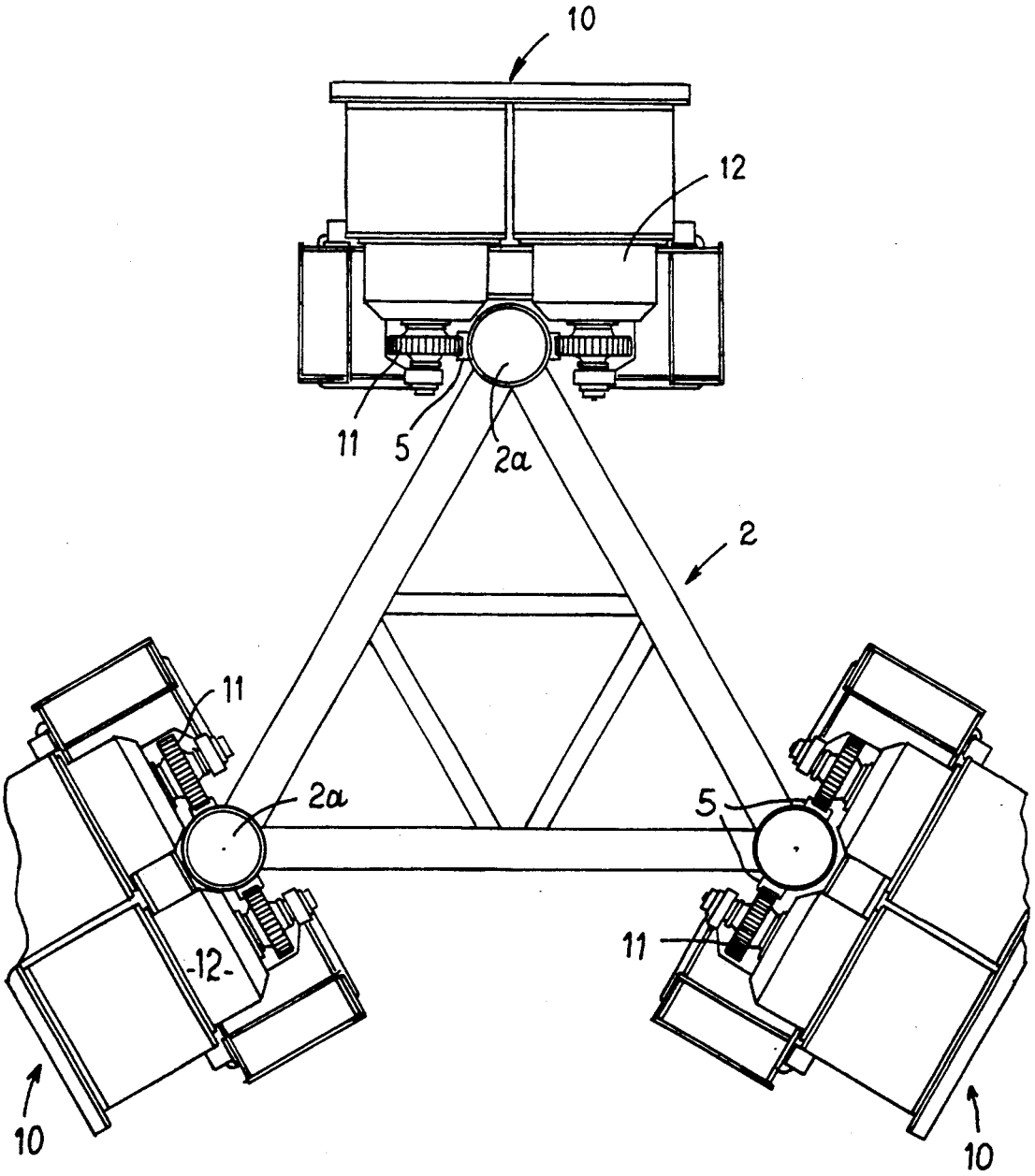
FIG. 3 is a view in section along the line 3—3 in FIG. 2.

To this end, and as illustrated in FIGS. 2 and 3, the posts 2*a* of the legs 2 are provided with diametrically opposite racks 5 arranged on part of the length of the legs 2 and with which output gears 11 of the drive mechanism 10 mounted on the hull 1 are intended to co-operate. Four output gears can, for example, be provided for each post 2*a*, each gear being equipped with a geared motor unit 12.

Figure 4:
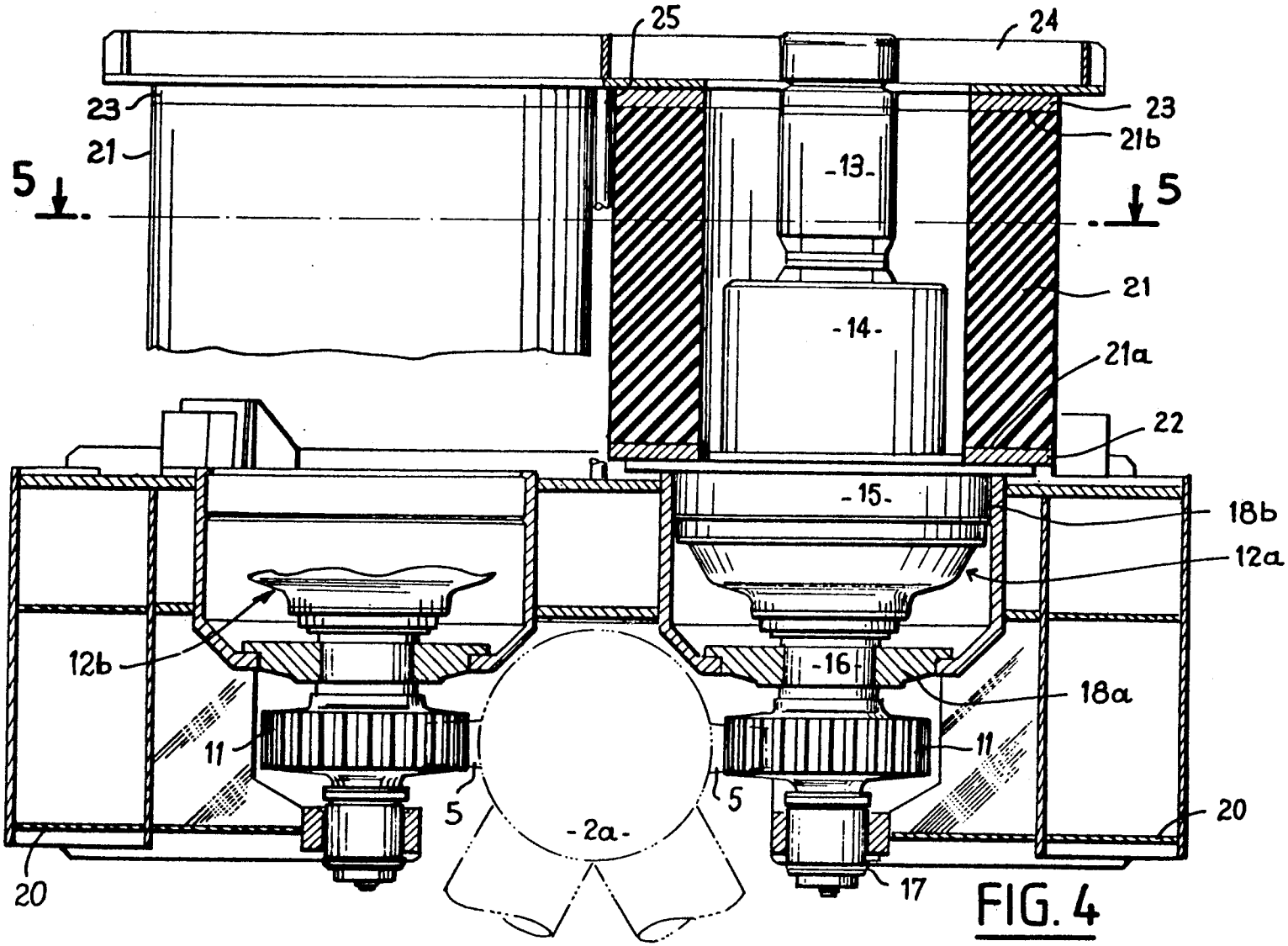
FIG. 4 is a view in half section of a first embodiment of a suspension device according to the invention.
Figure 5:
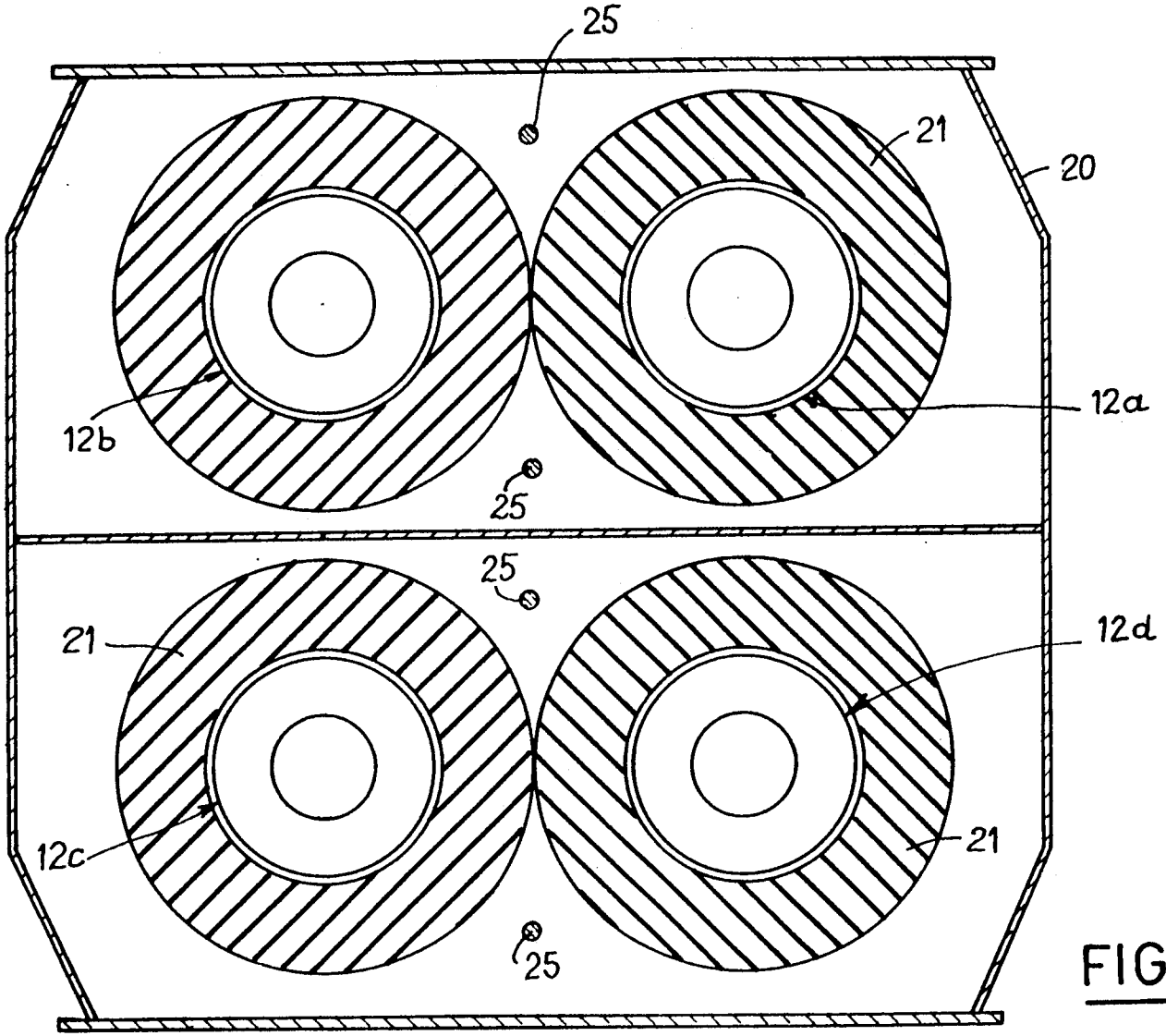
FIG. 5 is a view in section along the line 5—5 in FIG. 4.

Referring now to FIGS. 4 and 5, a drive and suspension mechanism 10 will now be described in greater detail. In these figures, the post 2*a* of a leg 2 provided with two opposite racks 5 has been represented in chain dotted lines.

The drive mechanism 10 comprises four geared motor units 12*a*, 12*b*, 12*c* and 12*d* in superposed and adjoining pairs.

Since each geared motor unit is identical, one unit 12*a* will now be described.

This unit 12*a* comprises a motor 13, for example an electric motor, driving first of all a first speed reducer 14 of high speed and low torque, which drives a second speed reducer 15 of, for example, the epicyclic type but of lower speed and higher torque, on the slowest output shaft 16 of which the gear 11 is keyed.

At its free end, the output shaft 16 is guided by a bearing 17 of a structure 20 integral with the hull. The speed reducer 15 is articulated on the structure 20 which supports the unit 12*a* via bearings 18*a* and 18*b* in such a way as to permit a certain angular deflection of the unit 12*a* and thus of the corresponding output gear 11 in the course of the lowering and placement of the leg, as will be seen below.

Moreover, the geared motor unit 12*a* comprises a member for absorbing energy, formed by a tubular twisting sleeve 21, inside which the motor 13 and at least the speed reducer 14 are housed, thus making it possible to construct a unit which is compact and of small size.

An end 21*a* of the sleeve 21 is fixed, for example by bonding, on a collar 22, which is integral with the speed reducer 15. An end 21*b* of the sleeve 21 is fixed, for example by bonding, on a collar 23.

The end 21*b* of the sleeve 21 is furthermore integral with a crosspiece 24 via the collar 23. This crosspiece 24 connects the sleeve 21 of unit 12*a* to the sleeve 21 of the adjoining unit 12*b*, likewise via a collar 23 (FIG. 4). The two units 12*a* and 12*b* are driven in opposite directions since their respective gears 11 mesh with the two opposite racks 5 situated on either side of the post 2*a*.

The same applies to the geared motor units 12*c* and 12*d*, whose sleeves 21 are interconnected at one of their ends by a crosspiece.

Figure 8:
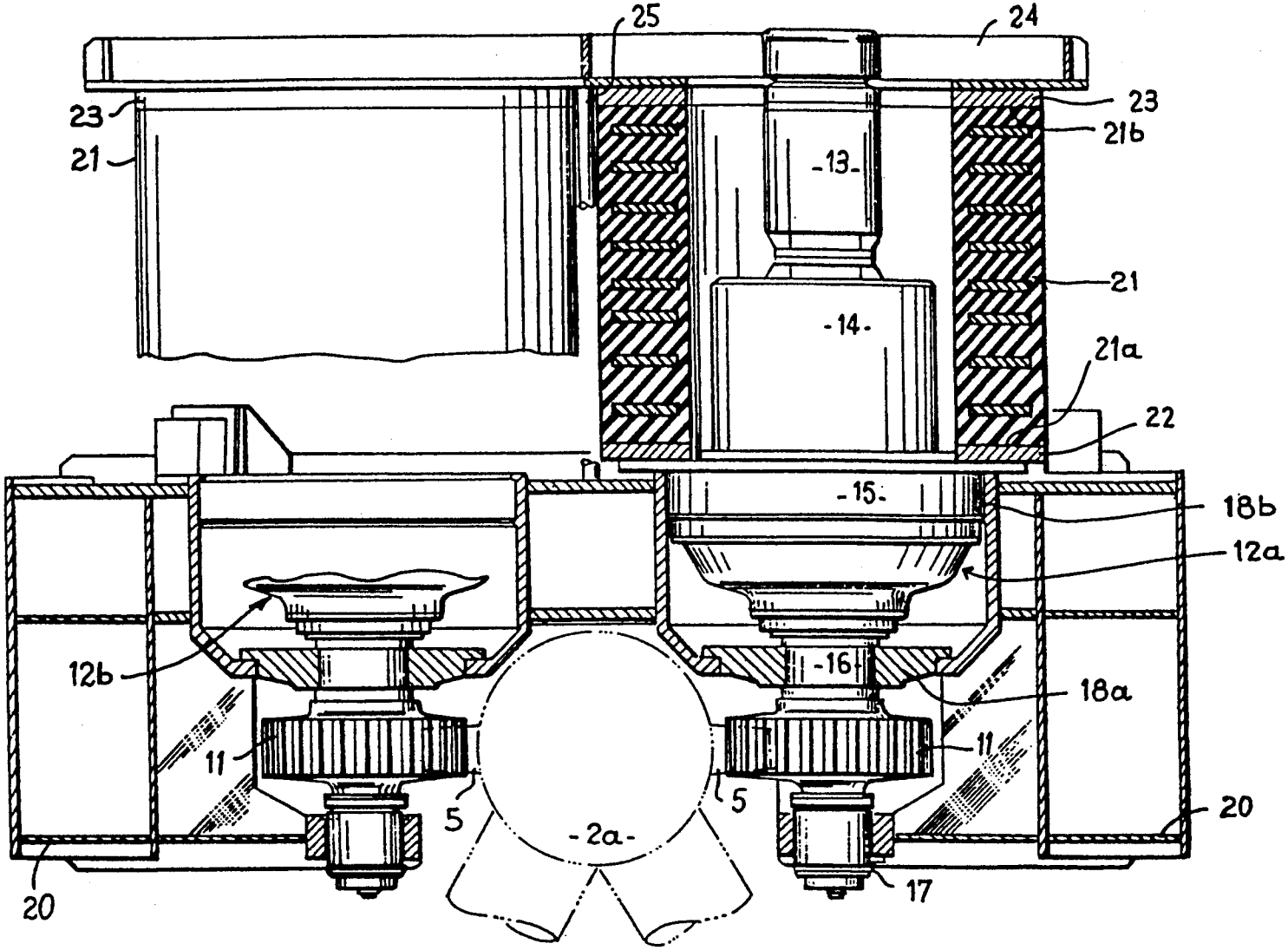
FIG. 8 is a view similar to FIG. 4, but showing a modified suspension device.

The sleeves 21 are constructed of an elastically deformable material, such as an elastomer. They can likewise be constructed of a laminated material formed by juxtaposition of rings of elastomer and rings of steel, e.g. as shown in FIG. 8.

In order to safeguard the adhesion of the bond between the ends of the sleeves 21 and the collars 22 and 23, in particular when the sleeves 21 tend to shorten due to torsion, the sleeves are prestressed in compression with the aid, for example, of ties 25 extending parallel to the axis of the sleeves 21. These ties 25 have one end integral with the structure 20 supporting the geared motor units 12*a*, 12*b*, 12*c* and 12*d* and the other end integral with the crosspiece 24 connecting two adjoining sleeves.

Each mechanism for the displacement and suspension of the hull 1 of the oil platform is thus constructed in this way.

The whole platform is thus floated to the drilling or extraction site and the legs 2 are lowered until they come into contact with the sea bed. For this purpose, the motors 13 thus drive, via the speed reducers 14 and 15, the output gears 11 which mesh with the racks 5. During the lowering of the legs 2, the motors 13 play the role of brakes.

At the moment of contact of the leg 2 with the sea bed at the end of the lowering operation, the impact can be very violent, given the movements of the hull under the action of a swell. The shock of the impact is transmitted by the racks 5 to the gears 11, then to the twisting sleeves 21 via each geared motor unit 12 in the form of a series of opposing torques. These torques balance each other due to the crosspieces 24 such that the shock is damped by the torsion of the two elastic sleeves 21 of the geared motor units 12*a* and 12*b* and of the two elastic sleeves 21 of the geared motor units 12*c* and 12*d*. This torsion thus permits a damping travel of the leg 2 upwards and creates an absorption of energy.

Figure 6:
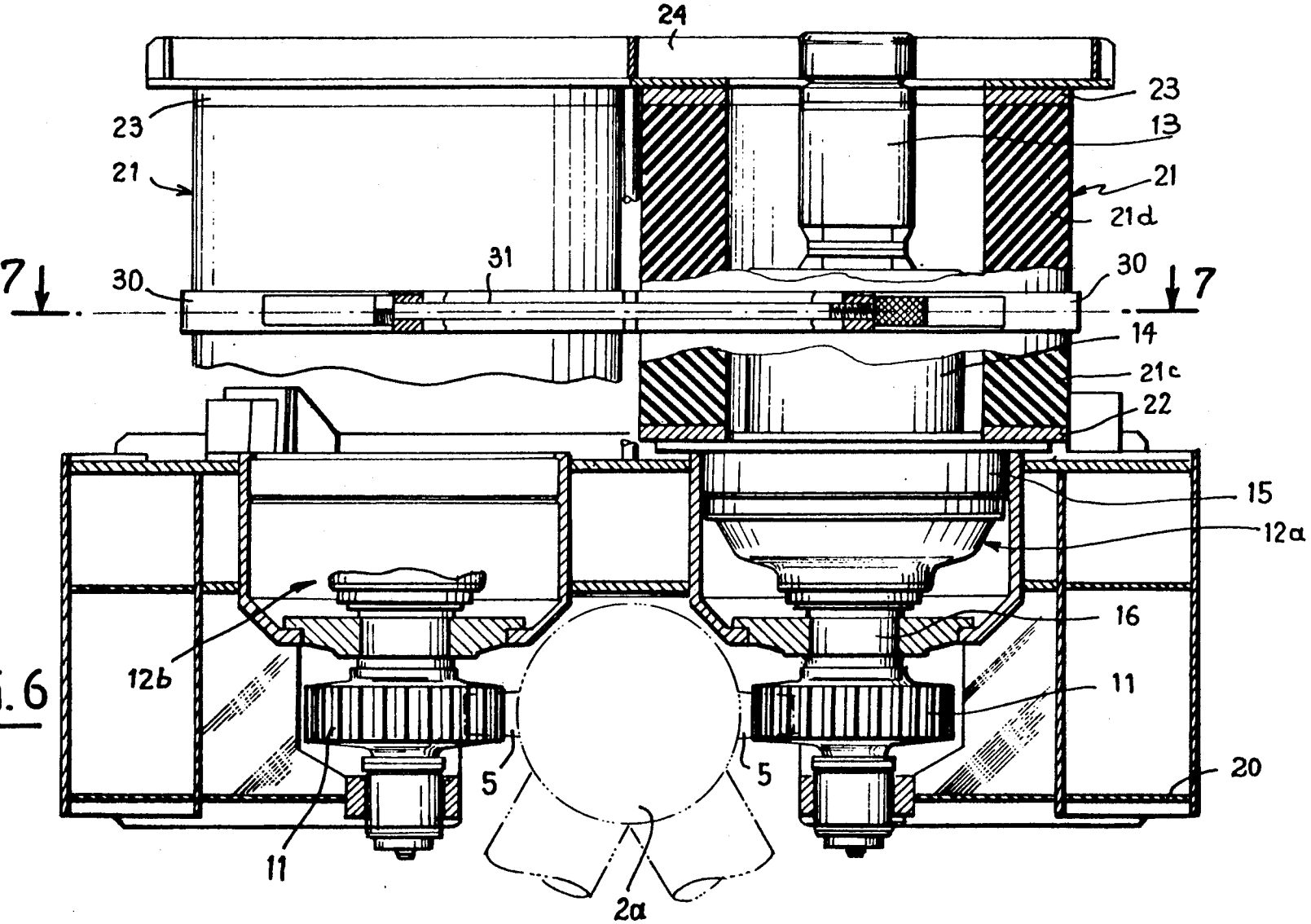
FIG. 6 is a view in half section of a variant of the suspension device according to the invention.
Figure 7:
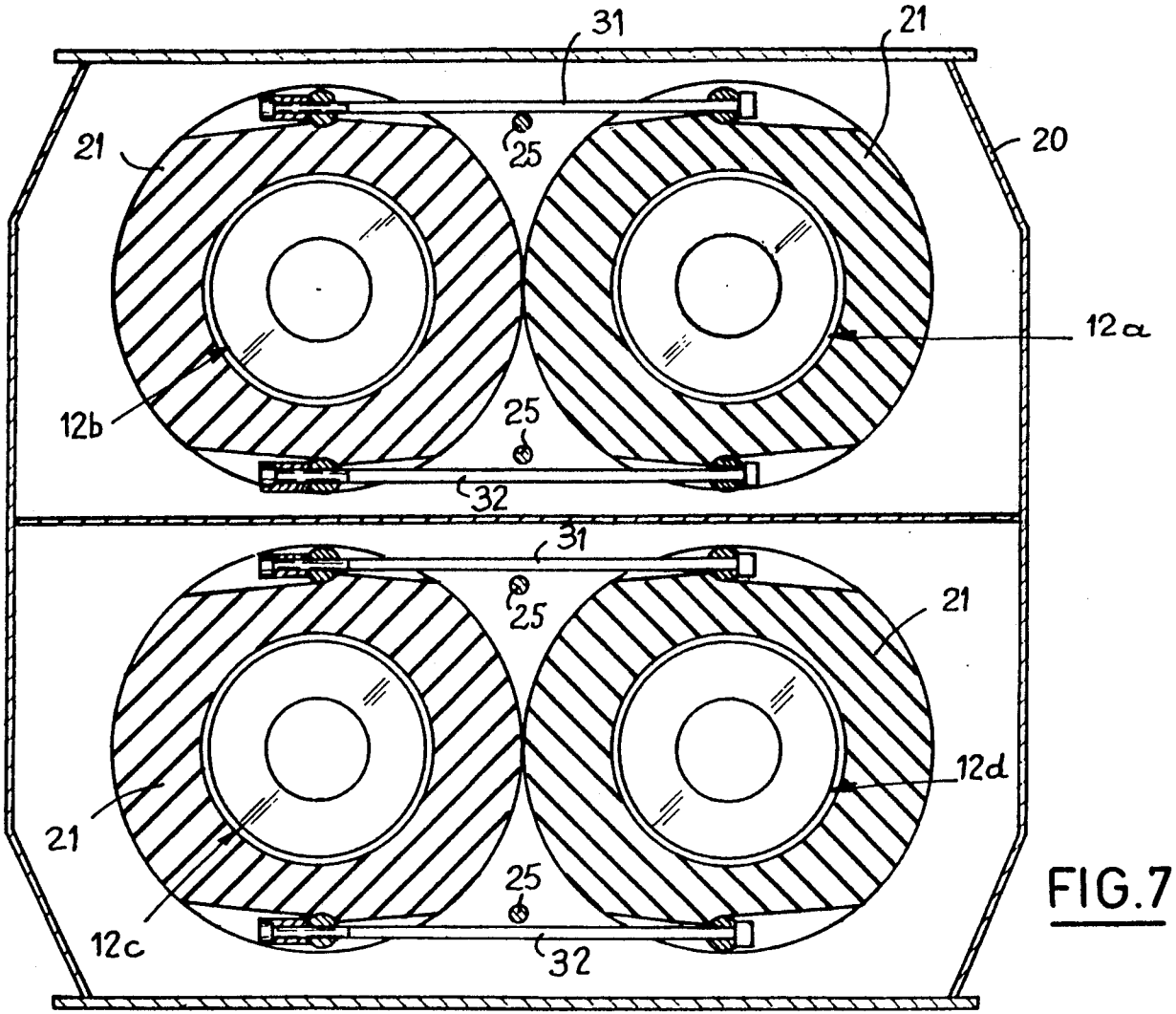
FIG. 7 is a view in section along the line 7—7 in FIG. 6.

In the embodiment in FIGS. 6 and 7, each twisting sleeve 21 is composed of two sections, for example a small section 21*c* and a longer section 21*d* separated by an intermediate collar 30 on which they are fixed, for example by bonding.

The collars 30 corresponding to two adjoining sleeves 21 are connected by two ties 31 and 32, which are adjustable in length and allow the collars to be mutually immobilized as regards rotation.

In this case, the twisting sleeves 21 can be used for two functions.

The first function, already described in relation to the first embodiment, which consists in damping the shock of the placement of a leg 2 on the sea bed, utilizes the entire length of the sleeves 21 and, in this case, the ties 31 and 32 are not installed, such that the collars 30 are free to rotate and the opposing torques are balanced by the crosspieces 24.

The second function is utilized after the legs 2 are placed on the bed and the hull is raised above the level of the sea.

Indeed, a certain flexibility between the legs 2 and the hull 1 should be created in order to avoid stress concentrations when the legs 2 are subjected to flexural stress under the action of swells and the wind.

For this purpose, only the small section 21*c* of the twisting sleeves 21 is used so that the flexibility will be limited. The ties 31 and 32 are thus installed between the intermediate collars 30 of each geared motor unit 12*a*, 12*b*, 12*c* and 12*d*.

This system is advantageous from the point of view of the cost of the installation, since it allows the interposition of elastic cushions between the structure 20 supporting the geared motor units and the hull 1 of the platform, as is customary in the prior art, to be dispensed with.

It can be seen that the various arrangements which have just been described utilize the interior cylindrical space delimited by the tubular shape of the sleeves 21 to house the motor 13 and at least one of the speed reducers, such as 14, allowing the construction of a unit which is compact and of low bulk and all the elements of which turn on their axis without endangering the personnel working on the platform.

Furthermore, the damping travel is very large since the number of torsional turns of the sleeves 21 is not limited.

In addition, the device according to the invention furthermore makes it possible to equalize the torques between all the speed reducers of the system for displacing the legs relative to the hull and thus offers the possibility of carrying out the placement of the platform in more severe sea conditions and thus within wider meteorological windows, which significantly reduces the costs of installation.

We claim:

1. In a device for the integrated suspension and manipulation of a leg supporting a jack-up oil platform having a hull mounted displaceably on a plurality of the legs, said device comprising a drive mechanism including at least two opposite units each formed by a motor associated with at least one speed reducer driving an output gear to cooperate with opposite racks to be mounted on at least part of the length of the leg, each of said opposite units of said drive mechanism being mounted in articulated fashion on a structure supporting said opposite units via at least one bearing allowing a determined angular deflection of each said unit and of each corresponding output gear, the improvement comprising:

said motor and said at least one speed reducer of each opposite unit being housed within an energy absorbing member operable, at the moment of placement of the leg on a sea bed, for limiting stresses due to flexure of the legs under the action of swells and wind.

2. The improvement according to claim 1, wherein said energy absorbing member comprises at least one twistable sleeve having a first end driven in rotation by the corresponding said unit and a second end integral with a crosspiece connecting respective adjoining sleeves of said two opposite units, said opposite units turning in opposite directions.

3. The improvement according to claim 2, wherein said sleeve of each said unit is formed by at least two sections separated by an intermediate collar on which is fixed one end of each said section.

4. The improvement according to claim 3, wherein the said intermediate collars of said adjoining units are interconnected by at least one tie that is adjustable in length for immobilizing said intermediate collars from relative rotation.

5. The improvement according to claim 2, wherein said sleeve of each said unit has each of its ends fixed on a respective collar.

6. The improvement according to claim 5, wherein said sleeve of each said unit is fixed on said collars by bonding.

7. The improvement according to claim 2, further comprising means for prestressing in compression said sleeve of each said unit.

8. The improvement according to claim 7, wherein said means for prestressing in compression comprises at least one tie extending parallel to the axis of said sleeve and having a first end integral with said structure supporting said units and a second end integral with said crosspiece connecting two adjoining said sleeves.

9. The improvement according to claim 2, wherein said sleeve is made of an elastomer or a similar elastic material.

10. The improvement according to claim 2, wherein said sleeve is made of a laminated material formed by a juxtaposition of rings of elastomer and rings of steel.

* * * * *